US006968657B2

(12) United States Patent
Siudzinski et al.

(10) Patent No.: US 6,968,657 B2
(45) Date of Patent: Nov. 29, 2005

(54) PATIO DOOR ASSEMBLY WITH EXTRUDED PLASTICS COMPONENTS

(75) Inventors: Paul A. Siudzinski, Springboro, OH (US); Jonathan C. Hauberg, Beavercreek, OH (US); David A. Stammen, Dayton, OH (US); Donald F. Schmidt, Springboro, OH (US); Dennis D. Cox, Middletown, OH (US)

(73) Assignee: Deceuninck North America, LLC, Monroe, OH (US)

( * ) Notice: Subject to any disclaimer, the term of this patent is extended or adjusted under 35 U.S.C. 154(b) by 0 days.

(21) Appl. No.: 09/993,969

(22) Filed: Nov. 14, 2001

(65) Prior Publication Data

US 2002/0032995 A1 Mar. 21, 2002

Related U.S. Application Data

(63) Continuation of application No. 09/439,275, filed on Nov. 12, 1999, now Pat. No. 6,318,036.

(51) Int. Cl.[7] ..... E06B 1/26; E06B 1/30

(52) U.S. Cl. ..... 52/207; 52/204.7; 52/204.51; 49/366; 160/92

(58) Field of Search ..... 52/207, 204.51, 52/204.57, 204.58, 204.7, 204.5; 16/354, 387; 49/365, 366, 409, 504; 160/90, 92, 119

(56) References Cited

U.S. PATENT DOCUMENTS

| | | | | |
|---|---|---|---|---|
| 2,889,588 A | | 6/1959 | Gillespie | |
| 2,918,708 A | * | 12/1959 | Sharp et al. | 52/656.3 |
| 2,953,824 A | | 9/1960 | Minick | |
| 2,970,642 A | * | 2/1961 | Parsons | 160/40 |
| 3,422,488 A | | 1/1969 | Horstman | |
| 3,526,922 A | * | 9/1970 | Kellems | 16/387 |
| 3,612,821 A | * | 10/1971 | Stromquist | 219/218 |
| 3,724,129 A | * | 4/1973 | Stromquist | 49/70 |
| 3,774,360 A | | 11/1973 | Hubbard et al. | |
| 3,908,730 A | * | 9/1975 | Goss et al. | 160/90 |
| 4,006,573 A | * | 2/1977 | Biebuyck | 52/730.6 |
| 4,068,433 A | | 1/1978 | Glover | |
| 4,229,905 A | | 10/1980 | Rush | |
| 4,319,430 A | * | 3/1982 | Menard | 49/404 |

(Continued)

FOREIGN PATENT DOCUMENTS

| | | | | |
|---|---|---|---|---|
| DE | 2754453 | * | 6/1979 | 52/207 |
| EP | 080870 | * | 11/1982 | 52/207 |
| EP | 633383 | * | 1/1995 | 52/211 |
| FR | 2501771 | * | 3/1981 | 52/211 |
| GB | 2110283 | | 6/1983 | |
| GB | 2147645 | | 6/1983 | |
| GB | 2191529 | * | 12/1987 | 52/204.1 |
| GB | 2276187 | * | 9/1994 | 52/207 |
| WO | 01/55540 | * | 8/2001 | 52/207 |

*Primary Examiner*—Phi Dieu Tran A
(74) *Attorney, Agent, or Firm*—Jacox, Meckstroth & Jenkins

(57) ABSTRACT

Sections of extruded rigid plastics material form a rectangular main frame including a pair of vertical jamb members, a top head member and a bottom sill member connected by welded mitered corners. An extruded plastic astragal member is spaced between the jamb members and has laterally projecting stop portions and internal walls which are rigidly connected by long screws to the head and sill members. A fixed door panel and a pivotal door panel have extruded plastic rectangular frames with welded mitered corner joints and which surround corresponding glazing panels. A continuous gear hinge has an inactive leaf secured to the astragal member and a slightly shorter active leaf. The door panel frames have internal walls which cooperate with the welded corner joints to maintain each frame flat, and long screws positively connect the leaves of the gear hinge to the pivotal door panel frame and the astragal member.

8 Claims, 4 Drawing Sheets

U.S. PATENT DOCUMENTS 4,399,636 A * 8/1983 Blackwell ..... 49/469
4,502,249 A * 3/1985 Banford ..... 49/381
4,532,743 A * 8/1985 Miller et al. ..... 52/207
4,569,154 A 2/1986 Bayer
4,573,287 A * 3/1986 Hagemeyer et al. ..... 49/381
4,644,696 A 2/1987 Bursk
4,689,933 A * 9/1987 Biro ..... 52/656.5
4,753,043 A 6/1988 Bockwinkel
4,761,853 A * 8/1988 Hoffman ..... 16/302
4,803,809 A 2/1989 Takemura
4,891,921 A 1/1990 Governale
4,941,288 A 7/1990 Morton
4,999,880 A 3/1991 Baer
5,255,473 A 10/1993 Kaspar et al.
5,341,600 A * 8/1994 Heppner ..... 49/471
5,435,106 A * 7/1995 Garries et al. ..... 52/204.5
5,461,829 A 10/1995 Lehto et al.
5,622,017 A * 4/1997 Lynn et al. ..... 52/209
5,645,330 A * 7/1997 Artwohl et al. ..... 312/116
5,651,223 A * 7/1997 Novak et al. ..... 52/211
RE35,618 E 10/1997 Goossens
5,675,947 A * 10/1997 Yane ..... 52/207
5,778,491 A * 7/1998 Baer ..... 16/354
5,822,923 A * 10/1998 Governale ..... 49/365
5,887,387 A * 3/1999 Dallaire ..... 49/408
5,913,786 A * 6/1999 Mayer ..... 52/204.7
6,055,782 A 5/2000 Morton et al.
6,058,665 A 5/2000 Halvorson, Jr. et al.
6,167,662 B1 * 1/2001 Gruber ..... 52/204.1
6,170,210 B1 * 1/2001 Marts ..... 52/232
6,256,931 B1 * 7/2001 Kenkel et al. ..... 49/450
6,497,265 B2 * 12/2002 Davis et al. ..... 160/87

* cited by examiner

PATIO DOOR ASSEMBLY WITH EXTRUDED PLASTICS COMPONENTS

BACKGROUND OF THE INVENTION

In the construction of patio door assemblies having one swinging door panel and one fixed door panel, it is common to form the jamb and head or members of wood and attaching the jamb members to an extruded plastic or aluminum sill member. A vertical astragal member is spaced between the jamb members and is also commonly formed of wood as are the rectangular frames for the fixed and swinging door panels. It is also common to use three or four butt hinges to mount the swinging door panel on either one of the jamb members or on the astragal member. The main patio door frame and each of the frames for the door panels have been constructed with sections of extruded plastics material such as a rigid polyvinylchloride (PVC). One of the jamb members or the astragal member and the adjacent extruded section of the swinging door frame are then notched or mortised for receiving a set of butt hinges.

The problems associated with previously produced patio door assemblies using extruded vinyl frame sections include the problems of sagging and warping of the main frame and/or the frame for the swinging door panel due to distortion of the different extrusions or profiles especially when the extrusions are notched for attaching the butt hinges. With any such patio door assembly using extruded rigid plastics or vinyl sections, it is highly desirable for the sections forming the main door frame and the sections forming the frame of each of the door panels to have a uniform profile or cross-sectional configuration so that the sections may be joined together with welded mitered corners to provide a high strength frame. The extruded sections and components should also be designed and assembled to eliminate the use of internal metal reinforcing members and to provide for substantial rigidity without distortion over an extended period of time.

SUMMARY OF THE INVENTION

The present invention is directed to an improved patio door assembly wherein a main door frame and the frame of each door panel are formed of extruded sections of a rigid plastics material or vinyl and are designed and assembled to eliminate sagging and/or warping of the main frame and/or the swinging door panel, and which also provide a neat and attractive appearance. The patio door assembly of the invention is also designed for easy and rapid assembly of the swinging door panel onto the astragal member and also provides for a rigid and durable support for the swinging door from the astragal member.

In accordance with a preferred embodiment of the invention, a main patio door frame is constructed with extruded vinyl jamb members, head member and sill member each having substantially the same profile and which are secured together with welded mitered corner joints. An extruded aluminum approach member snap-fits onto the outer portion of the vinyl sill member, and an extruded vinyl riser member is attached to the inner portion of the sill member. An extruded vinyl astragal member has parallel side walls with outwardly projecting stop portions, and includes internal laterally connecting walls with bosses which receive long screws extending through inner and outer portions of the sill and head members.

A fixed door panel and a swinging door panel have identical rectangular frames enclosing insulated glazing or glass panels, and each frame is formed with a vinyl extrusion having parallel spaced side walls and inner walls integrally connected by laterally extending walls perpendicular to the side and inner walls. The swinging door panel is supported by the astragal member with a continuous gear hinge having an inactive leaf with a locating tab and mounted on the astragal member by vertically spaced pairs of screws which extend through the astragal member and secure one side of the fixed door panel frame.

The continuous gear hinge has a slightly shorter active leaf with a curved edge portion and covers the adjacent edge surface of the pivotal door panel frame. The active leaf is secured to the door frame by long screws which thread into the internal cross walls of the door panel frame. The leaves of the continuous gear hinge function as a gauge for precisely spacing the pivotal door panel between the head and sill members. The vinyl frame of each door panel has welded mitered corner joints which cooperates with the profile of the frame to prevent warping of the door panel, and the support of the pivotal door panel with the astragal member and the continuous gear hinge prevents sagging of the door panel in both its open and closed positions.

Other features and advantages of the invention will be apparent from the following description, the accompanying drawings and the appended claims.

DESCRIPTION OF THE PREFERRED EMBODIMENT

Figure 1:
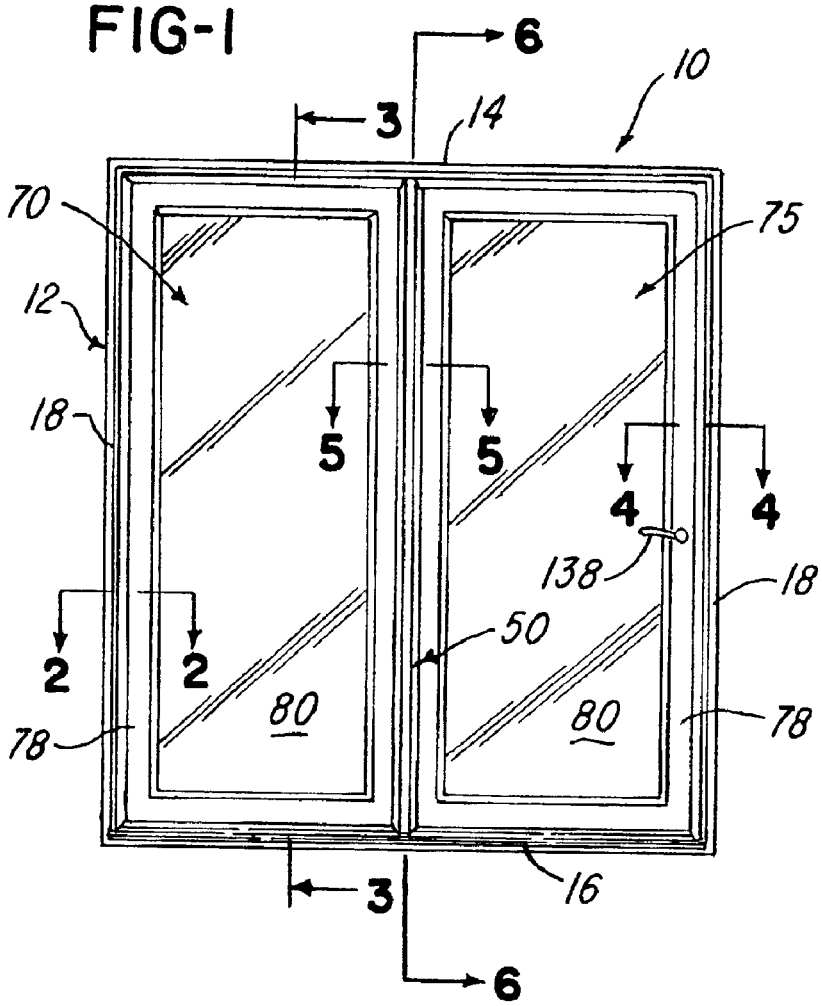
FIG. 1 is an exterior elevational view of a patio door assembly constructed in accordance with the invention.
Figure 2:
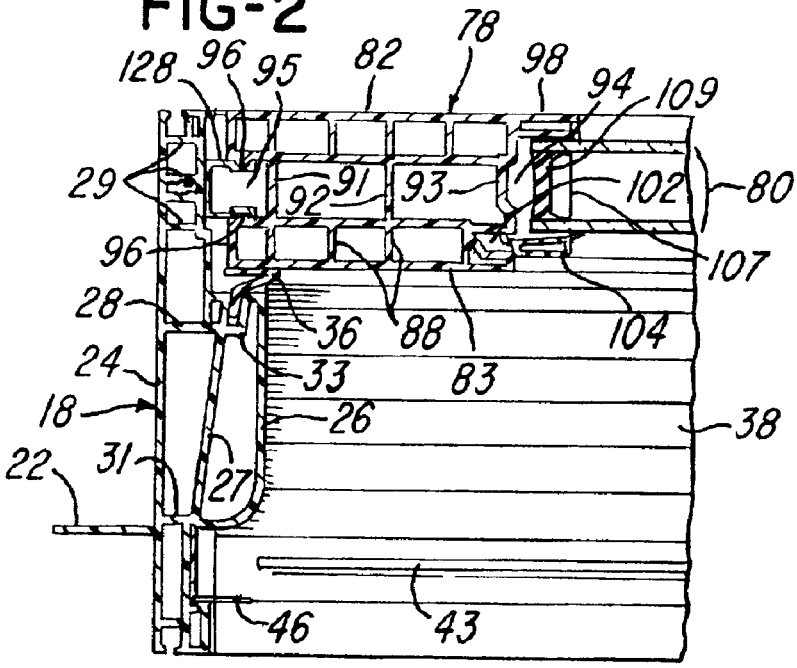
FIG. 2 is an enlarged fragmentary section taken generally on the line 2—2 of FIG. 1.
Figure 3:
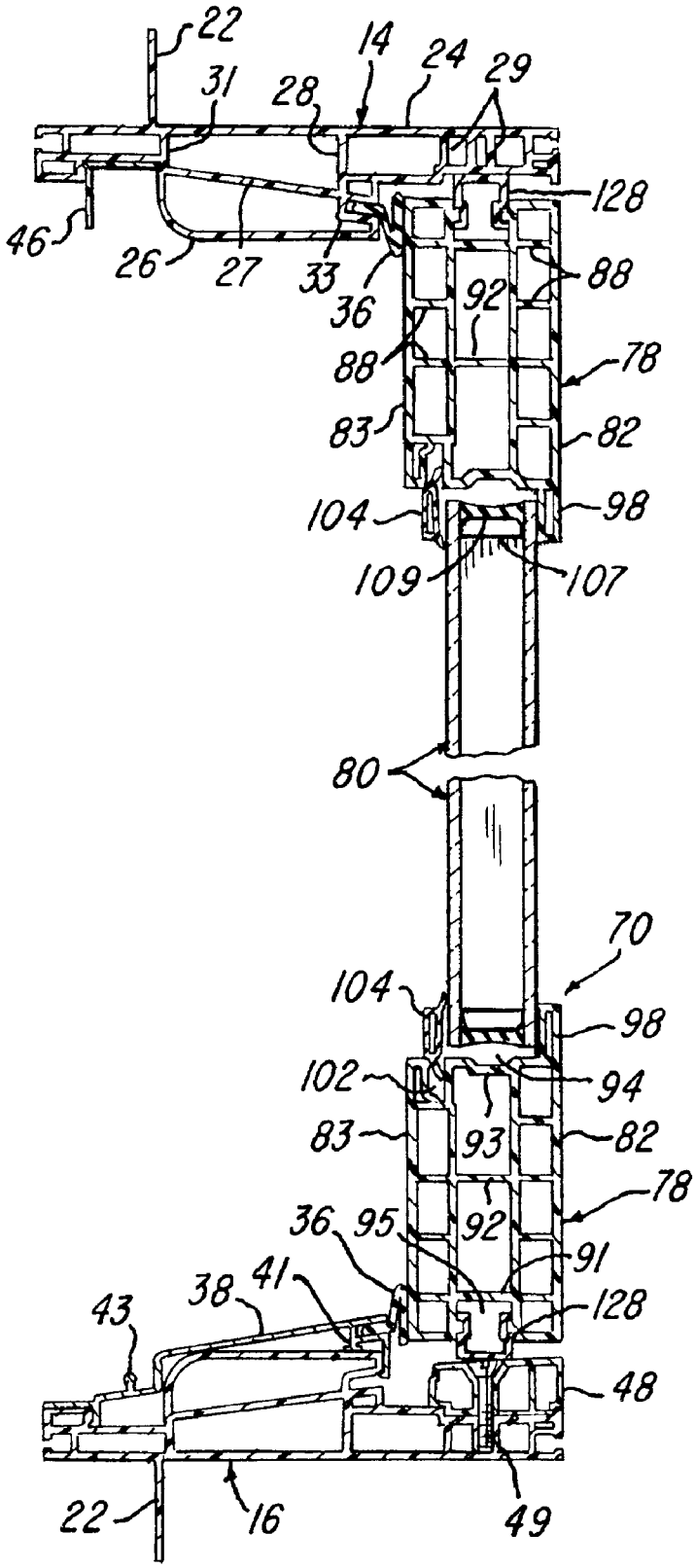
FIG. 3 is a vertical section taken generally on the line 3—3 of FIG. 1 with a center portion broken away.
Figure 4:
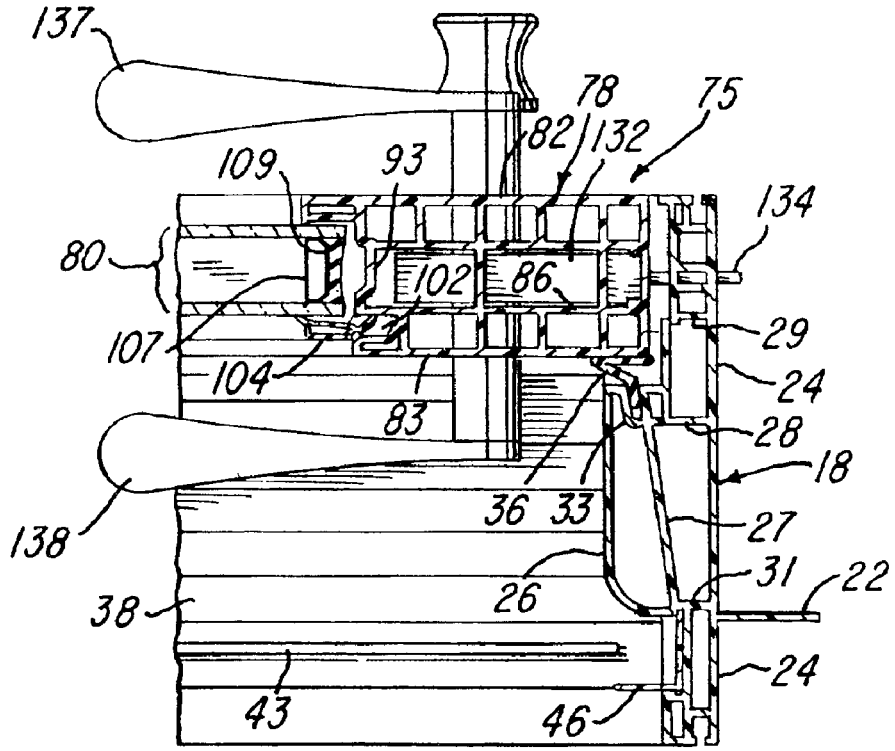
FIG. 4 is an enlarged fragmentary section taken generally on the line 4—4 of FIG. 1.

Referring to the drawings, FIG. 1 illustrates a patio door assembly 10 which includes a rectangular main frame 12 formed by a horizontal head member 14, a sill member 16 and a pair of vertical jamb members 18 (FIGS. 2–4). Each of the frame members 14, 16 and 18 are extrusions of a rigid plastics material such as rigid polyvinylchloride (PVC) and have the identical or substantially identical profile or cross-sectional configuration. The extruded sections or members are secured together by mitered and welded corner joints, and each of the frame members includes an outwardly projecting nailing flange 22. The flange 22 on the sill member 16 may be removed when it is desired to seat the sill member directly on a floor surface. As also shown in FIGS. 2–4, each of the frame members 14, 16 and 18 has an outer wall 24, a stepped inner wall 26 and an internal inclined reinforcing wall 27. A series of lateral or perpendicular walls 28, 29 and 31 integrally connect the walls 24, 26 and 27.

Each of the main frame members is also extruded with an integral U-shaped wall 33 defining a groove which receives a flexible and resilient door sealing member or strip 36 along both jamb members 18 and the head member 14. An extruded aluminum approach member 38 (FIG. 3) snap-fits onto the sill member 16 and also has a U-shaped wall portion 41 defining a groove which receives a bottom door sealing strip 36. The aluminum approach 38 is also formed with a track or rail 43 which extends across the sill member 16 and supports and guides the wheels of a sliding screen door (not shown). An L-shaped extruded plastic retainer 46 (FIG. 3) snap-fits into undercut grooves within the head member 14 and jamb members 18 and serves to retain the upper and side members of the sliding screen door frame. The sill member 16 also has a riser member 48 which is extruded of a rigid plastics material or PVC and is secured to the sill member 16 by a series of screws 49 spaced along the sill member 16.

Figure 5:
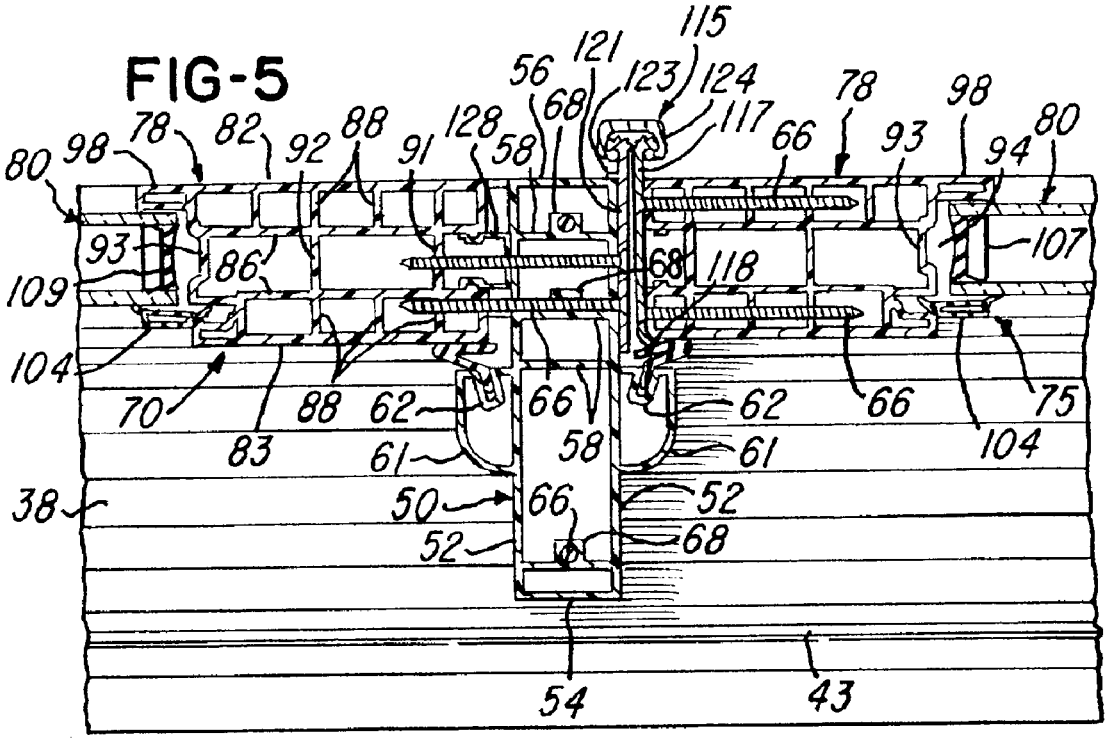
FIG. 5 is an enlarged fragmentary section taken generally on the line 5—5 of FIG. 1.
Figure 6:
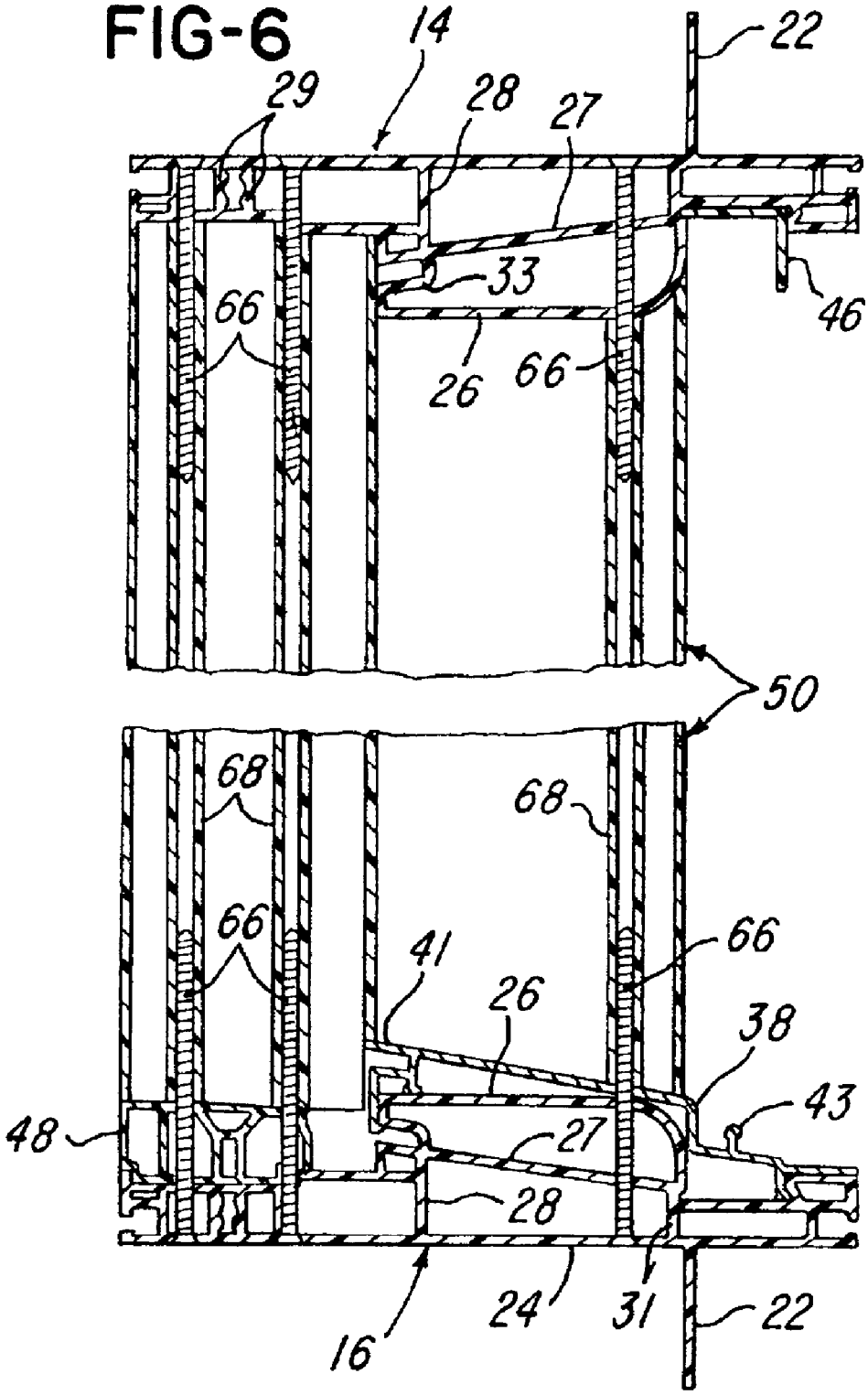
FIG. 6 is an enlarged fragmentary section taken generally on the line 6—6 of FIG. 1 and with a center portion broken away.

The main frame 12 of the patio door assembly also includes an astragal member 50 (FIGS. 5 & 6) which is also extruded of a rigid plastics material or PVC. The astragal member 50 includes parallel spaced vertical side walls 52 which are integrally connected by an exterior end wall 54, an interior end wall 56 and internal walls 58 which are perpendicular to the side walls 52 and reinforce the astragal member. As shown in FIGS. 5 and 6, the astragal member 50 with the exterior end wall 54 and the interior end wall 56, extends a substantial portion of the width of the frame members 14, 16 and 18. The exterior end wall 54 is positioned so that it is closely adjacent the frame of the sliding screen door mounted for lateral movement on the track or rail 43. The astragal 50 is extruded with a pair of laterally projecting hollow or tubular stop portions 61 each of which has a U-shaped wall portion 62 defining a groove which receives and retains a flexible and resilient door sealing strip 36.

Referring to FIG. 6, the upper and lower ends of the astragal member 50 are contoured to mate with the opposing surfaces of the head member 14 and the sill member 16 with the attached extruded aluminum approach panel 38 and the attached extruded plastic riser 48. A plurality of long flathead screws 66 extend downwardly through the head member 14 and upwardly through the sill member 16 and are threaded into corresponding tubular bosses 68 (FIG. 5) extruded as integral portions of three inner walls 58 of the astragal member 50. The screws 66 rigidly secure the astragal member 50 to the head member 14 and sill member 16.

Referring to FIG. 1, an inactive or fixed door panel 70 and an active or swinging door panel 75 are supported by the main frame 12, and each panel 70 and 75 includes a rectangular door frame 78 which is formed from sections of an extrusion of rigid plastics material or PVC. Each frame 78 supports insulated glazing or a sealed dual glass panel 80 and has the same profile or cross-sectional configuration around the entire frame 78. The frame 78 has mitered and welded corner joints, and each linear section or component of the frame 78 includes parallel spaced outer side walls 82 and 83 (FIG. 5) and parallel spaced inner walls 86. The parallel inner walls 86 and outer side walls 82 and 83 are integrally connected by laterally extending or perpendicular walls 88, and the inner walls 86 are integrally connected by laterally extending or perpendicular walls 91, 92 and 93. The wall 93 of each frame section defines a longitudinally extending recess 94, and the outer portions of the inner walls 86 define a longitudinally extending slot or cavity 95 with opposing ribs 96 (FIG. 2) projecting into the cavity.

As mentioned above, the profile or cross-sectional configuration of each frame 78 is uniform around the entire rectangular frame. However, the inner wall 82 has an inwardly projecting double wall flange 98, and the side wall 83 and a portion of the adjacent inner wall 86 define an inwardly projecting slot or groove 102. As shown in FIGS. 2–5, the peripheral edge portion of each dual glass or glazing panel 80 is captured and sealed between the double wall flange 98 of each door frame 78 and a removable plastic or PVC glazing strip or bead 104 which snap-fits into the groove 102 around the periphera of each glazing panel 80. In a conventional manner, the parallel spaced glass panes or panels of each glazing panel 80 are separated by an aluminum spacer tube 107 and are sealed together by an adhesive and resilient bonding material 109 such as silicone.

Referring to FIG. 5, the active or operable door panel 75 is pivotally supported for swinging movement by a continuous gear hinge 115 which has an active leaf 117 having a curved edge portion 118 for locating the leaf on the inner edge surface of the swinging door panel frame 78. The active leaf 117 is positively secured to the inner vertical rail or section of the door frame 78 by long vertically spaced pairs of flathead screws 66 which are threaded into the internal lateral walls 88 of the frame section. The vertical length of the active leaf 117 is the same as the vertical height of the swinging door panel frame 78, and the curved edge portion 118 of the active leaf 117 provides a seat for precisely and quickly positioning the active leaf 117 during attachment to the vertical frame section.

The continuous hinge 115 also has an inactive leaf 121 which extends the full height of the astragal member 50 and projects slightly above and below the active leaf 117. The inactive leaf 121 is formed with an integral tab 123 (FIG. 5) which quickly locates the leaf 121 precisely on the astragal member 50 in the same manner as the curved edge portion 118 locates the leaf 117 on the pivotal door panel frame 78. The continuous gear hinge 115 is preferably constructed as disclosed in U.S. Reissue Pat. No. RE 35,618 and includes a continuous C-shaped retainer or clamp 124 which encloses the curved mating edge portions of the leaves 117 and 121 and having the mating gear teeth.

As also shown in FIG. 5, the inactive leaf 121 of the gear hinge 115 is positively secured to the astragal member 50 by vertically spaced pairs of long screws 66 which extend laterally through the side walls 52 of the astragal member and also into the perpendicular walls 88 and 91 of the frame 78 for the inactive or fixed door panel 70. The opposite vertical section of the door frame 78 for the fixed door panel 70 is positively secured to the adjacent jamb member (FIG. 2) by a series of vertically spaced screws 66 (not shown) which extend through the jamb member 18 and are threaded into the internal lateral walls 91 and 92 of the adjacent frame section. As also shown in FIGS. 2, 3 & 5, a U-shaped vinyl spacer member or channel 128 snap-fits within the peripheral slot or groove 95 of the inactive door panel frame 78 and precisely positions the inactive door panel 70 between the head and sill members and between the adjacent jamb member 18 and astragal member 50.

Referring to FIG. 4, the spacing between the inner walls 86 of the frame 78 for the active or swinging door panel 75 is sufficient to receive a commercially available door lock unit 132 having a retractable blade or strike 134 which extends through a keeper (not shown) mounted on the adjacent jamb member 18. The door lock unit 132 operated by either an interior handle 137 or an external handle 138 for retracting and extending the locking strike 134. Above and below the latch strike 134 of the lock unit 132, the slot 95 within the vertical section of the swinging door panel frame 78 is closed by flat metal strips (not shown).

From the drawings and the above description, it is apparent that a patio door assembly constructed in accordance with the present invention, provides desirable features and advantages. For example, the profile or cross-sectional configuration of the vinyl head, sill and jamb members of the main frame 12 provides for a high strength main frame of economical construction. The same extrusion is used to form all members, and the cross-sectional profile provides the frame with strong welded miter corner joints. The attachment of the aluminum approach member 38 on the sill member 16 and the snap-in strips 46 on the head member 14 and jamb members 18 provide the sill member with high durability and also provide for convenient installation and retention of a sliding screen door.

The profile or cross-sectional configuration of the vinyl door panel frames 78 also provide each door panel with substantial rigidity to prevent warping or distortion of the door panels without requiring metal insert reinforcing strips. In addition, the profile of the vinyl astragal member 50 cooperates with the continuous gear hinge 115 to provide a strong and rigid support for the active or swinging door panel 75 and thereby prevent sagging of the door panel when the door panel is in either its open position or its closed position. The specific configuration of the continuous gear hinge 115 with the positioning tab 121 and curved edge portion 118 enables rapid and precision assembly of the gear hinge to the door panel 75 and the hinge to the astragal member 50 without any notching or mortising. The shorter active leaf 117 and the longer inactive leaf 121 of the hinge 115 not only covers the edge portion of the swinging door panel frame 78, but also precisely positions the door panel 75 vertically to provide the desired clearance between the door panel frame 78 and the head member 14 and the riser member 48 on the sill member 16.

The profile of the astragal member 50, as shown in FIG. 5, and its attachment to the head member 14 and sill member 16 with the long screws 66 within the internal bosses 68, further provide the astragal member with substantial strength which cooperates with the continuous gear hinge 115 to support the swinging door panel 75 so that the weight of the door panel 75 is distributed over the entire length of the door panel and astragal member 50.

While the patio door assembly herein described constitutes a preferred embodiment of the invention, it is to be understood that the invention is not limited to this precise assembly, and that changes may be made therein without departing from the scope and spirit of the invention as defined in the appended claims.

What is claimed is:

1. A patio door assembly comprising a rectangular main frame including a pair of vertical jamb members rigidly connected by a top head member and a bottom sill member, said main frame further including a vertical astragal member spaced between said jamb members and rigidly connected to said head and sill members, a first door panel within said main frame and including a rectangular door panel frame supporting a glass panel, a second door panel within said main frame and including a rectangular door panel frame supporting a glass panel, said astragal member and each of said door panel frames and said members of said main frame comprising extrusions of rigid plastics material, said main frame and each of said door panel frames having welded mitered corner joints, a hinge having an inactive leaf secured to said main frame and an active leaf secured to said frame of said second door panel, said head and jamb members including outwardly projecting double wall exterior portions defining laterally inwardly facing channels, elongated and removable plastic insert strips having an L-shaped cross-sectional configuration and forming snap-fit connections with undercut grooves within said channels, and said strips including laterally inwardly projecting flanges adapted to retain a frame of a sliding screen door within said head and jamb members.

2. A patio door assembly comprising a rectangular main frame including a pair of vertical jamb members rigidly connected by a top head member and a bottom sill member, said main frame further including a vertical astragal member spaced between said jamb members and rigidly connected to said head and sill members, a first door panel within said main frame and including a rectangular door panel frame supporting a glass panel, a second door panel within said main frame and including a rectangular door panel frame supporting a glass panel, said astragal member and each of said door panel frames and said members of said main frame comprising extrusions of rigid plastics material, said main frame and each of said door panel frames having welded mitered corner joints, a hinge having an inactive leaf secured to said main frame and an active leaf secured to said frame of said second door panel, said first door panel frame having spaced inner walls defining a peripherally extending and laterally outwardly facing external groove, said inner walls having opposing ribs projecting inwardly from said inner walls into said groove, a rigid spacer member confined within said groove and projecting outwardly from said groove completely around said rectangular door panel frame, and said spacer member comprises a spacer channel having U-shaped portions engaging said ribs with a snap-fit connection.

3. A patio door assembly as defined in claim 2 wherein said hinge extends continuously and vertically from said head member to said sill member, and said inactive leaf of said hinge is longer in a vertical direction than said active leaf of said hinge to provide for quickly and precisely mounting said second door panel in precise vertically spaced relation between said head and sill extrusions.

4. A patio door assembly as defined in claim 3 wherein said hinge comprises a continuous gear hinge extending continuously from said head member to said sill member.

5. A patio door assembly as defined in claim 2 wherein said astragal extrusion includes parallel spaced opposite vertical side walls integrally connected by interior and exterior vertical end walls, vertical stop portions integral with said side walls and projecting laterally outwardly from said side walls adjacent said frames of said door panels, a plurality of vertical internal walls integrally connecting said side walls, and said internal walls spaced inwardly adjacent said interior and exterior end walls of said astragal extrusion and having longitudinally extending vertical portions defining holes receiving vertical threaded fasteners extending through said head and sill extrusions.

6. A patio door assembly comprising a rectangular main frame of rigid plastic material and including a pair of vertical jamb extrusions rigidly connected by a top head extrusion and a bottom sill extrusion, a vertical astragal extrusion of rigid plastic material and spaced between said jamb extrusions and rigidly connected to said head and sill extrusions, a first door panel within said main frame, a swinging second door panel within said main frame, said first and second door panels each including a rectangular door panel frame of rigid plastic material with welded corners and supporting a glass panel, each of said rectangular door panel frames including peripherally extending elongated door frame extrusions each having a substantially rectangular cross-sectional configuration, each said door frame extrusion having longitudinally extending and parallel spaced outer side walls and spaced inner walls integrally connected by longitudinally extending transverse walls defining a lateral width for said frame extrusion substantially greater than the thickness defined by said outer side walls, each said door frame extrusion including a laterally inwardly projecting integral flange and a removable glazing bead extrusion spaced from said flange and receiving the corresponding said glass panel therebetween, a door latch mechanism disposed between said inner walls of said door panel frame of said second door panel, a hinge having an inactive leaf secured by threaded fasteners to said astragal extrusion, said hinge having an active leaf secured by threaded fasteners threaded into said spaced transverse walls of an adjacent said frame extrusion of said second door panel, a metal approach extrusion mounted on said sill extrusion of plastic material, said approach extrusion having an upwardly projecting horizontal track extending between said jamb extrusions and adapted to support a sliding screen door, said approach extrusion including an integral inner portion defining an inwardly facing groove, and an elongated horizontal door seal extending within said groove within said approach extrusion and having an inwardly projecting flexible portion disposed above a horizontal channel in said sill extrusion and in pressure contact with said door frame.

7. A patio door assembly comprising a rectangular main frame of rigid plastic material and including a pair of vertical jamb extrusions rigidly connected by a top head extrusion and a bottom sill extrusion, a vertical astragal extrusion of rigid plastic material and spaced between said jamb extrusions and rigidly connected to said head and sill extrusions, a first door panel within said main frame, a swinging second door panel within said main frame, said first and second door panels each including a rectangular door panel frame of rigid plastic material with welded corners and supporting a glass panel, each of said rectangular door panel frames including peripherally extending elongated door frame extrusions each having a substantially rectangular cross-sectional configuration, each said door frame extrusion having longitudinally extending and parallel spaced outer side walls and spaced inner walls integrally connected by longitudinally extending transverse walls defining a lateral width for said frame extrusion substantially greater than the thickness defined by said outer side walls, each said door frame extrusion including a laterally inwardly projecting integral flange and a removable glazing bead extrusion spaced from said flange and receiving the corresponding said glass panel therebetween, a door latch mechanism disposed between said inner walls of said door panel frame of said second door panel, a hinge having an inactive leaf secured by threaded fasteners to said astragal extrusion, said hinge having an active leaf secured by threaded fasteners threaded into said spaced transverse walls of an adjacent said frame extrusion of said second door panel, an angular insert strip having a first flange releasably attached by a snap-fit to exterior portions of said head and jamb extrusions, and said strip having a laterally inwardly projecting flange cooperating with said head and jamb extrusions to define a channel adapted to receive an optional sliding screen door frame.

8. A patio door assembly comprising a rectangular main frame of rigid plastic material and including a pair of vertical jamb extrusions rigidly connected by a top head extrusion and a bottom sill extrusion, a vertical astragal extrusion of rigid plastic material and spaced between said jamb extrusions and rigidly connected to said head and sill extrusions, a first door panel within said main frame, a swinging second door panel within said main frame, said first and second door panels each including a rectangular door panel frame of rigid plastic material with welded corners and supporting a glass panel, each of said rectangular door panel frames including peripherally extending elongated door frame extrusions each having a substantially rectangular cross-sectional configuration, each said door frame extrusion having longitudinally extending and parallel spaced outer side walls and spaced inner walls integrally connected by longitudinally extending transverse walls defining a lateral width for said frame extrusion substantially greater than the thickness defined by said outer side walls, each said door frame extrusion including a laterally inwardly projecting integral flange and a removable glazing bead extrusion spaced from said flange and receiving the corresponding said glass panel therebetween, a door latch mechanism disposed between said inner walls of said door panel frame of said second door panel, a hinge having an inactive leaf secured by threaded fasteners to said astragal extrusion, said hinge having an active leaf secured by threaded fasteners threaded into said spaced transverse walls of an adjacent said frame extrusion of said second door panel, each of said door panel frames defines a peripherally extending and laterally outwardly facing external groove each defined by spaced inner walls having opposing ribs projecting into said groove, and a rigid spacer channel having U-shaped portions engaging said ribs with a snap-fit connection.

* * * * *